US009820541B2

(12) United States Patent
King

(10) Patent No.: US 9,820,541 B2
(45) Date of Patent: Nov. 21, 2017

(54) WHEELED LUGGAGE CASE ARRANGEMENT

(71) Applicant: Samsonite IP Holdings S.a r.l., Luxembourg (LU)

(72) Inventor: William L. King, Swansea, MA (US)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 14/138,623

(22) Filed: Dec. 23, 2013

(65) Prior Publication Data

US 2014/0182990 A1 Jul. 3, 2014

Related U.S. Application Data

(60) Provisional application No. 61/747,623, filed on Dec. 31, 2012.

(51) Int. Cl.
*A45C 5/14* (2006.01)
*A45C 13/26* (2006.01)

(52) U.S. Cl.
CPC ..... *A45C 5/14* (2013.01); *A45C 13/262* (2013.01); *A45C 2005/142* (2013.01)

(58) Field of Classification Search
CPC ..... A45C 13/385; A45C 5/14; A45C 13/262; A45C 5/146; A45C 3/004; A45C 3/00; B62B 5/0083
USPC .... 190/18 A, 18 R; 280/47.18, 62, 641, 652, 280/47.315, 47.17; 16/47
See application file for complete search history.

(56) References Cited

U.S. PATENT DOCUMENTS

| | | | | |
|---|---|---|---|---|
| 1,822,893 | A * | 9/1931 | Kapolkin | 280/651 |
| 2,463,391 | A * | 3/1949 | Kanaley | 190/18 A |
| 2,550,291 | A * | 4/1951 | Phelps | A01C 7/18 111/24 |
| 2,596,578 | A * | 5/1952 | McIntyre et al. | 280/47.17 |
| 2,805,077 | A * | 9/1957 | Katz | B62B 5/0083 190/18 A |
| 4,118,048 | A * | 10/1978 | Spranger | B62B 3/006 190/18 A |
| 4,463,840 | A * | 8/1984 | Seynhaeve | 190/18 A |
| 4,679,670 | A * | 7/1987 | Wickman | 190/18 A |

(Continued)

FOREIGN PATENT DOCUMENTS

| | | | |
|---|---|---|---|
| EP | 0106906 | A1 | 5/1984 |
| WO | 2006/097960 | A1 | 9/2006 |

*Primary Examiner* — Fenn C Mathew
*Assistant Examiner* — Cynthia Collado
(74) *Attorney, Agent, or Firm* — Dorsey & Whitney LLP

(57) ABSTRACT

A luggage case may include opposing front and back walls, opposing sidewalls, opposing end walls, and multiple wheels. The front, back, side, top and end walls together thereby define an outer structure and enclosed space of the case. The wheels may include a pair of axially spaced apart fixed axis wheels with a common fixed rotational axis substantially perpendicular to the front and back walls and located towards a bottom corner of the case and at least one spinner wheel assembly mounted to the case to rotate at least one wheel about at least two orthogonal axes and located on the bottom end of the case spaced a distance along the width (W) of the case from the common fixed rotational axis of fixed wheels. Such a case can be wheeled over and cope better with rough terrain than a more conventional luggage article, while still being relatively manoeuvrable.

17 Claims, 5 Drawing Sheets

(56) References Cited

U.S. PATENT DOCUMENTS

| | | | | | |
|---|---|---|---|---|---|
| 4,848,782 | A * | 7/1989 | Schmidt | 280/47.131 | |
| 5,044,476 | A * | 9/1991 | Seynhaeve | 190/18 A | |
| 5,178,244 | A * | 1/1993 | Liang | 190/18 A | |
| 5,197,578 | A * | 3/1993 | Van Hooreweder | 190/18 A | |
| 5,318,315 | A * | 6/1994 | White | B62B 1/10 | 280/47.18 |
| 5,692,761 | A * | 12/1997 | Havlovitz | B62B 1/006 | 280/33.994 |
| 5,762,168 | A * | 6/1998 | Miyoshi | A45C 13/262 | 190/115 |
| 5,992,588 | A * | 11/1999 | Morszeck | 190/18 A | |
| 6,076,641 | A * | 6/2000 | Kinzer et al. | 190/18 A | |
| 6,139,029 | A * | 10/2000 | Shaw | B62B 13/18 | 280/47.371 |
| 6,193,265 | B1 * | 2/2001 | Yemini | B60B 37/10 | 280/47.31 |
| 6,523,839 | B2 * | 2/2003 | Simmons | B62B 3/10 | 280/47.26 |
| 7,891,678 | B2 * | 2/2011 | Anderson | B25H 3/00 | 280/30 |
| 8,118,146 | B2 * | 2/2012 | Shalgi | 190/18 A | |
| 8,684,374 | B2 * | 4/2014 | Skijus | B62B 1/20 | 280/47.31 |
| 8,714,570 | B2 * | 5/2014 | Skijus | B60N 3/026 | 16/422 |
| 8,720,655 | B2 * | 5/2014 | King | 190/18 A | |
| 2005/0230935 | A1 * | 10/2005 | Sauermann | B60D 1/065 | 280/508 |
| 2005/0230936 | A1 * | 10/2005 | Van Horn | A45C 7/0022 | 280/641 |
| 2010/0270764 | A1 * | 10/2010 | Odle | B62B 1/12 | 280/47.19 |
| 2012/0126502 | A1 * | 5/2012 | Robinson | B62B 1/202 | 280/47.31 |

* cited by examiner

WHEELED LUGGAGE CASE ARRANGEMENT

CROSS-REFERENCE TO RELATED APPLICATION

This application claims the benefit, under 35 U.S.C. §119(e), of U.S. provisional application No. 61/747,623, entitled "Wheeled Luggage Case Arrangement" and filed on Dec. 31, 2012, which is hereby incorporated in its entirety by reference herein.

TECHNICAL FIELD

The present invention relates to a luggage article, and in particular to wheeled luggage cases and more specifically to the wheel arrangements for such wheeled luggage cases.

BACKGROUND

Luggage items and in particular luggage cases (suitcases) now conventionally include wheels and tow handle arrangements to allow them to be wheeled and more easily moved by a user. Originally a pair of fixed axis wheel were provided at one end and on the sides of a case to allow the case to be wheeled on one end in a length wise manner (long side of the case generally horizontal). An example of such an arrangement is the Samsonite Oyster suitcase. This arrangement with a pair of wheels has evolved to provide additional fixed axis wheel at both ends of the case, and also to use wheels that are mounted to also rotate about a vertical axis (so called spinner wheels). An example of such a configuration with fixed and spinner type wheels is shown in EP 0106906. More recently there has been a change to provide cases that are arranged to be wheeled in a more vertical orientation (i.e. with their longest sides/dimension) vertical, and an increasing trend to provide four spinner type wheels on the bottom end. Such multiple spinner wheels allow better maneuverability of the case and easier user handling. Such an arrangement is now the standard default configuration.

A problem with wheeled cases is that in order to minimise the overall dimensions of the case which include the wheels, it is desirable to minimise the size of the wheels. Small wheels however are less able to cope and operate on rough surfaces. Spinner wheels in particular take up a lot of space with the actual diameter of the wheel having to be reduced to minimise overall space. A further general problem is to provide a suitcase that can more easily cope with stairs, with in general cases having to be manually carried up and down stairs.

It is therefore desirable to provide an improved luggage article, and more specifically an improved wheel arrangement on a luggage case that addresses the above described problems and/or which more generally offers improvements or an alternative to existing arrangements.

SUMMARY

According to the present invention there is therefore provided a luggage article as described in the accompanying claims.

In an embodiment of the invention, a luggage article may include opposing front and back walls, opposing side walls, opposing end walls, and a plurality of wheels to allow the luggage article to be wheeled. The opposing front and back walls form major faces of the luggage article and define a height and a width of the luggage article. The opposing sidewalls form side faces of the luggage article extending between the opposing front and back walls and defining a depth of the luggage article. The opposing end walls form top and bottom end faces of the luggage article wherein the front, back, side, top and end walls together define an outer structure and an enclosed space of the luggage article. The height dimension of the luggage article is greater than the width dimension which is greater than the depth dimension. The plurality of wheels comprise a pair of fixed axis wheels having a common fixed rotational axis and being axially spaced apart with the common fixed rotational axis substantially perpendicular to the major faces and located towards a bottom corner of the major faces, and at least one spinner wheel assembly that is mounted to the luggage article to rotate at least one wheel about at least two orthogonal axes and that is located on the bottom end face of the luggage spaced a distance along the width from the common fixed rotational axis of fixed wheels.

Such a luggage article can be wheeled over and cope better with rough terrain than a more conventional luggage article, which still being relatively maneuverable, and offers an improvement and alternative to conventional luggage articles.

The fixed axis wheels preferably have a peripheral rim that projects beyond the bottom end and beyond an adjacent side face of the luggage article. Such an arrangement allows the luggage article to be more easily dragged and wheeled up steps or stairs.

The fixed axis wheels may have a diameter that is at least 25%, and preferably at least 50%, of the width of the luggage article. Such wheels are much larger than conventional wheels and are better able to be wheeled over rough terrain.

The luggage article preferably comprises an opening line formed in said side faces and end walls along which said luggage article separates into a lid section and base section to allow access to the enclosed space within the luggage article. The opening line may be parallel to and closer to one of the major faces than to the other opposing major face. Alternatively the opening line may be more centrally located.

The luggage article may comprise a single spinner wheel assembly. Alternatively there may be a pair of spinner wheel assemblies located spaced apart across the depth of the bottom end of the luggage article.

Preferably the luggage article includes a tow handle extending above the top end of the luggage article. The tow handle preferably retractably extends above the top end of the luggage article. The tow handle may be located substantially centrally between front and back major faces. Alternatively the tow handle is located substantially adjacent to the front or back wall of the luggage article, and furthermore may be located substantially centrally across the width of one of the major faces of the luggage article. The tow handle preferably comprises a grip portion that extends substantially across the full width of the top end of the luggage article.

The luggage article is preferably a hardside luggage case wherein the front, back and side walls and top and bottom ends are all rigid and self-supporting.

BRIEF DESCRIPTION OF THE DRAWINGS

The present invention will now be described by way of example only with reference to the following figures in which.

DETAILED DESCRIPTION

Figure 1:
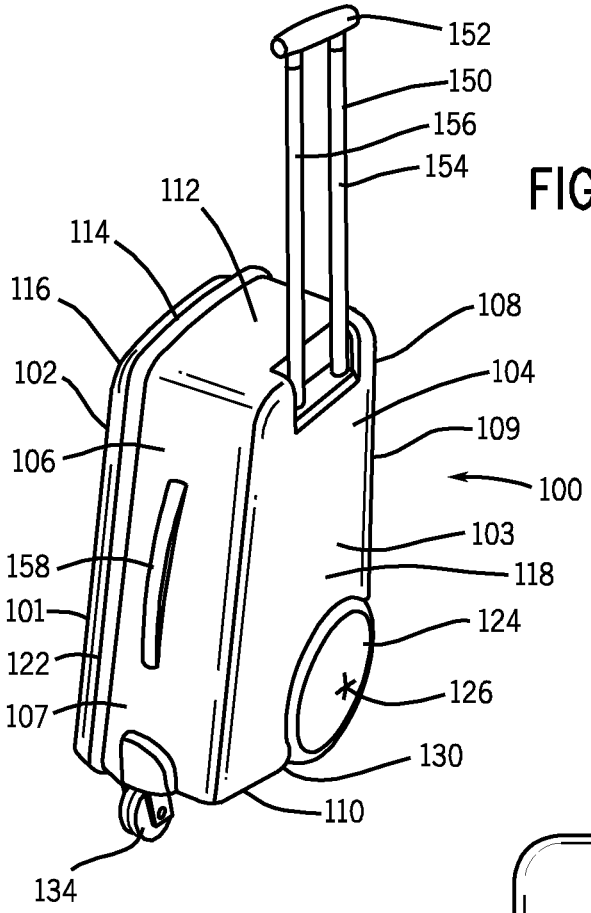
FIG. 1 is a schematic rear perspective view of a luggage case according to an embodiment of the invention.
Figure 2:
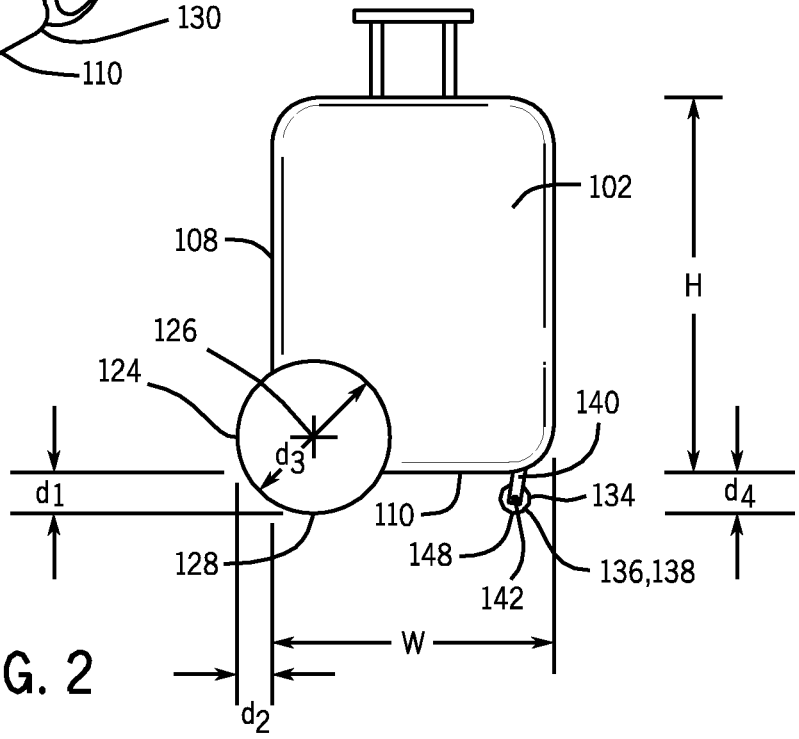
FIG. 2 is a schematic front view of a luggage case shown in FIG. 1.
Figure 3:
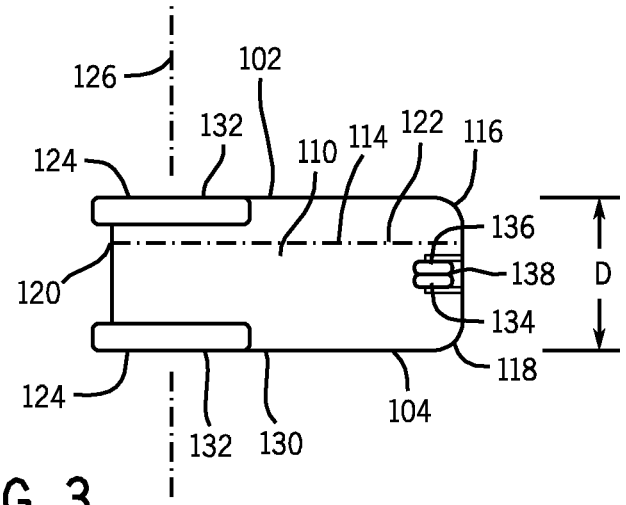
FIG. 3 is a schematic bottom end view of a luggage case shown in FIG. 1.

Referring to FIGS. 1-3, a wheeled luggage case 100 according to an embodiment of the invention includes a generally cuboid structure formed from a plurality of walls 102, 104, 106, 108, 110, 112 defining an enclosed internal volume of the luggage case 100 in which to contain a user's belongings. The luggage case 100 includes opposing front and rear walls 102,104 forming major front and rear faces 101, 103 of the luggage case 100, opposing side walls 106, 108 forming side faces 107, 109 of the case 100, and opposing top and bottom end walls 110, 112 of the case 100 that together all define a housing or an outer structure of the case 100 that, in turn, defines an enclosed internal volume. The major front and rear faces 101, 103 have a height H and a width W of the case 100. The side faces 107, 109 have a similar height H and a depth D of the case 100. The top and bottom ends 110, 112 of the case 100 extend across the width W and depth D of the case 100. The height H of the major faces 101, 103, and so of the case 100, is greater than the width W of the case 100, which is greater than the depth D of the case sides 106, 108 and the case 100.

The case 100 is of a type generally known as a hard side case in which the outer structure and walls 102, 104, 106, 108, 110, 112 of the case 100 are relatively rigid. The outer structure of the luggage case 100 may be, for example, plastic (e.g., composite plastic, acrylonitrile butadiene styrene, polymer, thermoplastic, and so forth) and may be manufactured by extrusion, mold forming, blow molding, and so forth.

The case 100 is split along a generally vertical plane and opening line 114 parallel to the major faces 101, 103 into a lid section 116, which includes the front wall 102, and a base section 118, which includes the rear wall 104. In this embodiment, the opening line 114 is located parallel to, and much closer or adjacent to, the front face 101 such that the base section 118 comprises the rear wall 104 and a majority of the side and top and bottom walls 106, 108, 110, 112, and the lid section 114 comprises substantially just the front wall 102. In other embodiments, the opening line may be much more centrally located mid-way between the front and rear faces 101, 103 such that the lid and base sections are more similarly sized.

The lid section 116 is connected to the base section 118 along on a side via a hinge 120 in a conventional manner, and the case 100 is opened at the opening line 114 to access the internal volume. The hinge 120 may be formed of a zipper and a fabric strip, a piano hinge, discrete hinges spaced apart, or an articulating joint. The piano hinge, the discrete hinges, or the articulating joint may be made from metal, plastic, any other suitable material, or any combination thereof. The hinge 120 may be stitched to the lid 116 and also to the base 118, or may be coupled in another suitable manner. In some examples, the luggage case 100 may be hinged along the left or the right side wall 106, 108, whereas in other examples, the luggage case 100 may be hinged along the bottom 110, or along any other face of the luggage case 100. A zipper 122 along a periphery of the opening line 114 or other conventional closure arrangement, for example clamp locks, secures the lid section 116 to the base section 118 to close the case 100.

A pair of fixed axis wheels 124 are mounted respectively on the opposing front and rear walls 102, 104 of the case 100, axially spaced apart by substantially the depth D of the case 100. The fixed axis wheels 124 rotate about a common fixed axis 126, which is generally perpendicular to the front and rear faces 101, 103 and generally horizontal. Each of the fixed axis wheels 124 is located at a bottom end corner of the case 100. In other words, each fixed axis wheel 124 is located near the bottom end 110 and one side wall 108 of the case 100. A peripheral rim 128 and edge of the fixed axis wheels 124 project a distance d1 beyond the bottom end wall and a distance d2 beyond a side wall 108 of the case 100 to allow the case to be supported on the ground on the fixed axis wheels 124. The fixed axis wheels 124 are relatively large, as compared to conventional suitcase wheels, and may preferably have a diameter d3 of at least 25% of the width W of the major face 101, 103 of the case 100 to which they are mounted and more preferably of at least 50% of the width W of the case 100. Each fixed axis wheel 124 may preferably be located in a recess 130 formed within either the front or rear face 101, 103 of the case such that an axial end face 132 of each fixed axis wheel 124 is substantially flush with one of the front and rear major faces 101, 103.

A spinner wheel assembly 134 is mounted from the bottom end wall 110 of the case 100. The spinner wheel assembly 134 may be spaced from the fixed axis wheels 124 a distance along the width W of the case 100 and may be preferably located at an end of the bottom end wall 110 of the case 100 that is opposite the end of the bottom end wall 110 that is proximate to the fixed axis wheels 124. In this embodiment, a single spinner wheel assembly 134 is located centrally across the depth D of the case 100 mid-way between the front and rear walls 102,104. In other embodiments, however, in particular if the case 100 has a more central opening line 114, a pair of spinner wheel assemblies may be provided spaced across the bottom end wall and spaced across the depth of the case. Such a pair of spinner wheels are more stable but increase the weight of the case 110 and the number of components and make the case 100 less maneuverable. The spinner wheel assembly 134 is of a conventional construction and comprises, in this case, a pair of wheels 136, 138 (although only one wheel may be provided in other embodiments). The pair of wheels 136, 138 are rotationally mounted to a spinner fork bracket 140 to rotate about a wheel axis 142, which is generally horizontal and parallel to the bottom wall 110 of the case 100, and the fork bracket 140 is rotationally mounted to the bottom end wall 110 of the case 100 to rotate about a generally vertical spinner axis 146 perpendicular to the bottom end wall 110 of the case 100. Such an arrangement allows the spinner wheels 136, 138 to rotate about two orthogonal axes 142, 146: the horizontal wheel axis 142 and the vertical spinner axis 146. The spinner wheel assembly 134 projects beyond the bottom wall 110 of the case 100 such that a peripheral rim 148 of the spinner wheels 136, 138 projects beyond the bottom end wall 110 by a distance d4. This distance d4 is preferably the same distance d1 as the peripheral rim and edge 128 of the fixed axis wheel 124 project beyond the bottom end wall 110. This, in turn, allows the case 100 to be supported on the ground on the fixed axis and spinner wheels 124, 134 with the case 100 in a vertical upright orientation with the side and front and rear walls 102, 104, 106, 108 vertical and the top and bottom walls 110, 112 generally horizontal with the ground and further allows the case 100 to be wheeled along the ground on the fixed axis 124 and spinner wheel assemblies 134 in a stable upright orientation as shown in FIG. 4A.

The luggage case 100 also includes a telescoping tow handle 150, which can be extended above the top wall 112 of the case 100 to an extended position at a convenient height for a user to hold. The telescoping tow handle 150 may be used to pull, direct, and wheel the case 100. In particular in this case, the tow handle 150 is oriented to have a grip portion 152 that is parallel to the rear face 103 of the case 100 with a user using the handle 150 to guide the case 100 in a forward side on direction shown by arrow A. The tow handle 150 in this embodiment telescopically extends from the case 100 adjacent to, and in the center of, the rear face 103 of the case 100 and comprises two parallel tubes 154, 156 interconnected at one top end by the grip portion 152. In other embodiments, for example as shown FIGS. 6 to 8, the handle 250 may comprise a pair of tubes 254, 256 that extend from adjacent opposing side walls 206, 208 of the case 200, are interconnected at a top end by a much longer grip portion 252 that extends across substantially the entire width W of the case 200, and are located more centrally across the depth D of the case 200 midway between and extending parallel to the front and rear faces 101, 103. The tow handle 150, 250 can be retracted to a retracted position in which it does not substantially extend beyond the top 112,212 of the case 110 and in which the grip portion 152, 252 is generally flush and/or close to the top wall 112, 212. The luggage case 100 may also include one or more fixed carry handle(s) 158 to facilitate carrying or lifting the luggage case. A side fixed handle 158 may be positioned on the left 106 wall as shown or alternatively or additionally on the right side wall 108, the top 112, and/or the bottom 110 of the luggage case 100.

Figure 4A:
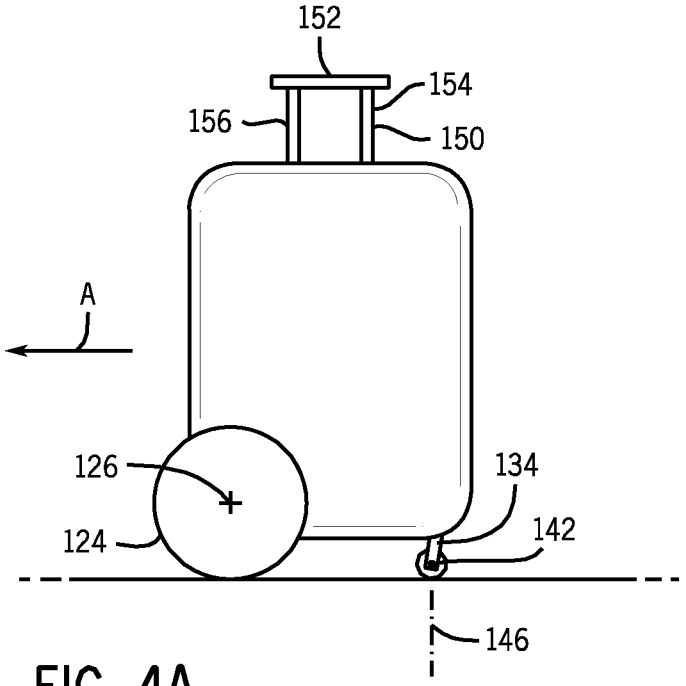
FIGS. 4A and 4B are schematic illustrations showing the orientation of the case shown FIG. 1 as it is wheeled in a first and second orientations.
Figure 4B:
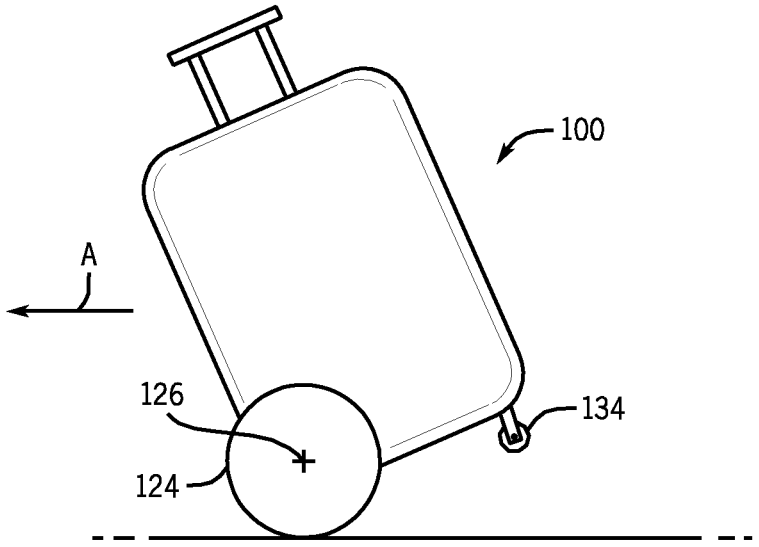
Figure 5:
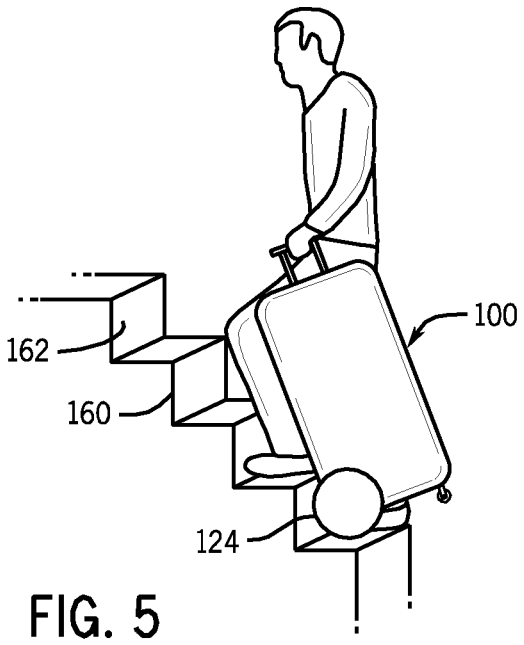
FIG. 5 is a schematic view illustrating a user wheeling the luggage case shown in FIG. 1 up a set of stairs.

In use, the case 100 can be wheeled in the upright orientation as shown in FIG. 4A, preferably in a forward side on direction, shown by arrow A, using the tow handle 150, with the fixed axis wheels 124 first and the spinner wheel assembly 134 trailing and with the spinner wheel assembly 134 allowing the case 100 to be steered and turned left and right about the fixed axis wheels 124. With the relatively large diameter fixed axis wheels 124 leading as the case 100 is wheeled, the case 100 is better able to cope with any bumps or rough terrain, as compared to a case with smaller wheels, while still being maneuverable and able to be turned due to the combination with the spinner wheel assemblies 134. In particular, the case 100 has a relatively short wheel base measured between the axis 126 of the fixed wheels 124 and axis 142,146 of the spinner wheel assembly 134, which improves its maneuverability as compared to a case that has a greater wheel base or that is wheeled in a different orientation, for example along its longest dimension. Furthermore, the fixed axis wheels 124, having a fixed axis 126 and being aligned parallel to the front and rear faces 101,103 of the case 100, also better guide the case 100 in a straight line, in particular over rough terrain, than would be the case if all the wheels were of a spinner type. In addition, to further cope with rough terrain, the case 100 may be tilted into an forward angled orientation and then dragged supported just on the fixed axis wheels 124 with the user maintaining the tow handle 150 and case at an angle as shown in FIG. 4B so that the spinner wheel assembly 134 remains off the ground in order to keep the spinner wheel assembly 134 from being snagged or caught on the rough terrain. The case 100 can also be relatively easily dragged up steps or stairs 160 as shown in FIG. 5 with the relatively large fixed axis wheels 124, which project from the side wall 108, engaging a front vertical wall 162 of the steps 160 allow the case 100 to be pulled and rolled up the front wall 162 and steps 160 relatively easily.

Figure 6:
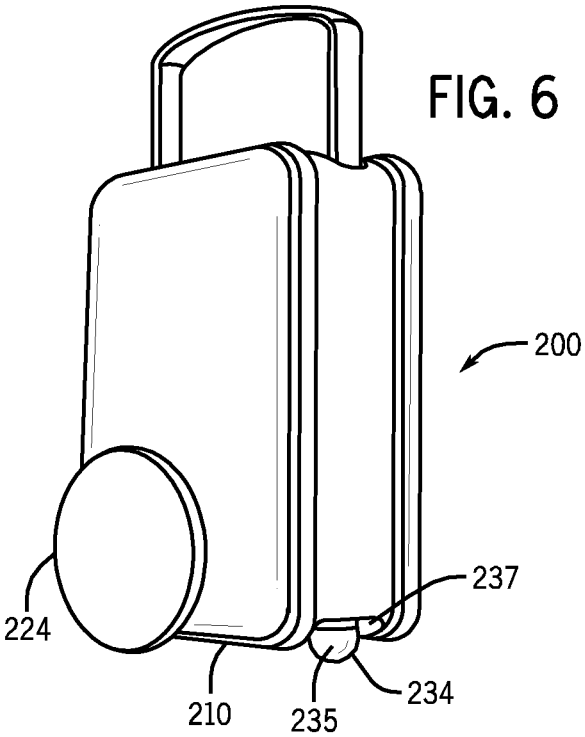
FIG. 6 is a schematic perspective view of a luggage case according to another embodiment of the invention.
Figure 7:
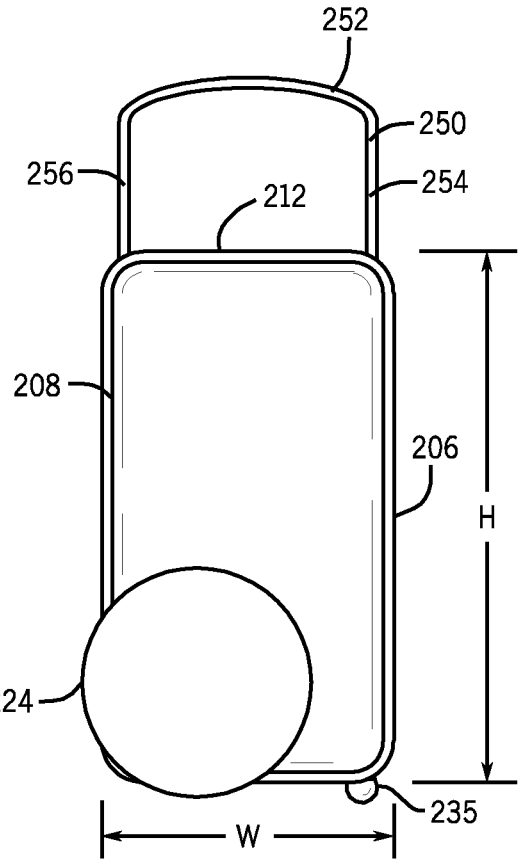
FIG. 7 is a schematic front view of a luggage case shown in FIG. 6.
Figure 8:
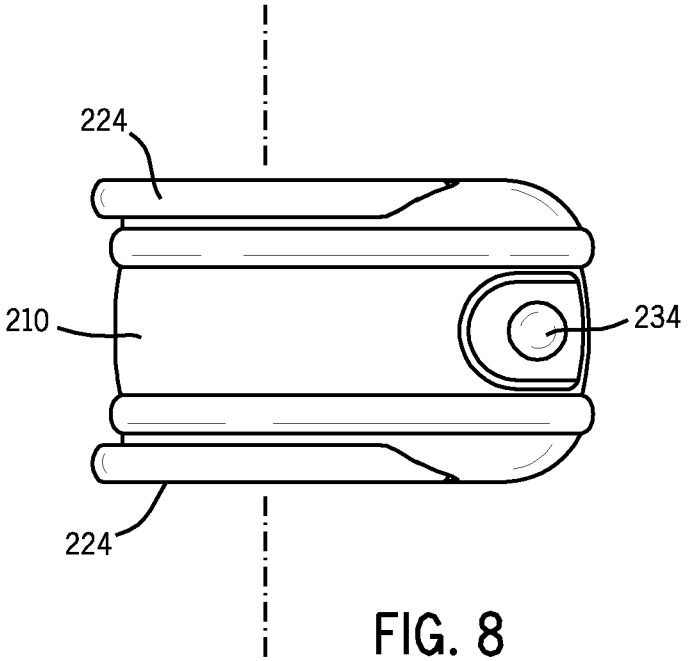
FIG. 8 is a schematic bottom end view of a luggage case shown in FIG. 6.

FIGS. 6 to 8 show a case 200 according to an alternative embodiment of the invention. This case 200 is generally similar to the first case 100. For example, the case 200 includes large fixed axis wheels 224 and a single spinner wheel assembly 234. However, as mentioned above, the case 200 includes a tow handle 250 that extends across the full width W of the case 200. In addition, the fixed axis wheels 224 in this embodiment are larger. The spinner wheel assembly 234 in this embodiment is also located in a small recess 237 in the bottom wall 210 of the case 200 such that it does not project from the bottom 210 of the case 200 as much. Furthermore in this embodiment the spinner wheel assembly 234 comprises a ball wheel 235, which is mounted to the case 200 such that it can freely rotate about the spherical outer surface of the ball 235 and multiple axes.

While these embodiments have been described in relation to a hard side suitcases, and these are the preferred embodiments of the invention, the invention may be incorporated into a soft side case in which the walls and outer housing structure of the case are made of a textile and/or more flexible material and the case includes a frame to support the wheels and other components. In addition the concept of providing relatively large fixed axis wheel in combination with a spinner type wheels on a bottom end of the case which is shorter than the height of the case, and which is to be wheeled in an upright orientation side-on, can also be applied to other luggage articles for example a wheeled duffle type bag.

The apparatuses and associated methods in accordance with the present disclosure have been described with reference to particular embodiments thereof in order to illustrate the principles of operation. The above description is thus by way of illustration and not by way of limitation. Various modifications and alterations to the described embodiments will be apparent to those skilled in the art in view of the teachings herein. Those skilled in the art may, for example, be able to devise numerous systems, arrangements and methods which, although not explicitly shown or described herein, embody the principles described and are thus within the spirit and scope of this disclosure. Accordingly, it is intended that all such alterations, variations, and modifications of the disclosed embodiments are within the scope of this disclosure as defined by the appended claims.

Where appropriate, common reference words are used for common structural and method features. However, unique reference words are sometimes used for similar or the same structural or method elements for descriptive purposes. As such, the use of common or different reference words for similar or the same structural or method elements is not intended to imply a similarity or difference beyond that described herein.

In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A luggage article comprising:

opposing front and back walls forming major faces of the luggage article and defining a height and a width of the luggage article;

opposing side walls forming side faces of the luggage article extending between the opposing front and back walls, the side walls defining a depth of the luggage article, wherein the height of the luggage article is greater than the width which is greater than the depth;

opposing end walls forming top and bottom end faces of the luggage article wherein the front, back, side, and end walls together define an outer structure and enclosed space of the luggage article;

an opening line traversing the side walls and the end walls; and a plurality of wheels to allow the luggage article to be wheeled, the plurality of wheels comprising a pair of fixed axis wheels and at least one spinner wheel assembly;

wherein:

the pair of fixed axis wheels is axially spaced apart with a common fixed rotational axis;

the common fixed rotational axis is substantially perpendicular to the major faces and the pair of fixed axis wheels is positioned on a bottom corner of the major faces;

the at least one spinner wheel assembly is mounted to the luggage article to rotate at least one wheel of the at least one spinner wheel assembly about at least two orthogonal axes;

the at least one spinner wheel assembly is located on the bottom end face of the luggage article and is spaced a distance from the common fixed rotational axis of the fixed wheels along the width of the luggage article; and a portion of each fixed axis wheel extends beyond the bottom end face and one of the side faces of the luggage article.

2. A luggage article as claimed in claim 1, wherein each of the fixed axis wheels include a peripheral rim that projects beyond the bottom end face and beyond an adjacent side face of the luggage article.

3. A luggage article as claimed in claim 1, wherein the fixed axis wheels include a diameter that is at least 25% of the width of the luggage article.

4. A luggage article as claimed in claim 1 comprising an opening line formed in said side faces and end walls along which said luggage article separates into a lid section and base section to allow access to the enclosed space within the luggage article.

5. A luggage article as claimed in claim 4, wherein the opening line is parallel to and closer to one of the major faces than to the other opposing major face.

6. A luggage article as claimed in claim 1 comprising a single spinner wheel assembly.

7. A luggage article as claimed in claim 1 comprising a pair of spinner wheel assemblies located spaced apart across the depth of the bottom end face of the luggage article.

8. A luggage article as claimed in claim 1 comprising a tow handle extending above the top end face of the luggage article.

9. A luggage article as claimed in claim 8, wherein the tow handle retractably and vertically extends along the height of the luggage article and above the top end face of the luggage article.

10. A luggage article as claimed in claim 8, wherein the tow handle is located substantially centrally between front and back major faces.

11. A luggage article as claimed in claim 8, wherein the tow handle is located substantially adjacent to the front or back wall of the luggage article, the tow handle further comprising a grip portion that is parallel to the front or back wall and extends along the width of the luggage article.

12. A luggage article as claimed in claim 11, wherein the tow handle is located substantially centrally across the width of one of the major faces of the luggage article.

13. A luggage article as claimed in claim 8, wherein the tow handle comprises a grip portion that extends substantially across the full width of the top end face of the luggage article.

14. A luggage article as claimed in claim 1 comprising a hardside luggage case wherein the front, back, side, and end walls are all rigid and self-supporting.

15. A luggage article as claimed in claim 1, wherein the fixed axis wheels include a diameter that is at least 50% of the width of the luggage article.

16. A luggage article as claimed in claim 1, wherein:

the height of the luggage article is defined between the opposing end walls defining top and bottom end faces of the luggage article; and the width of the luggage article is defined between the opposing side walls.

17. A luggage article as claimed in claim 1, wherein when each of the plurality of wheels contacts a support surface, the height of the luggage article extends approximately orthogonal to the support surface.

* * * * *